United States Patent [19]

Gränitz et al.

[11] 4,012,825

[45] Mar. 22, 1977

[54] METHOD OF EXCHANGING SUPPORTING OR DRIVING ROLLERS IN A CONTINUOUS CASTING PLANT AND APPARATUS FOR CARRYING OUT THE METHOD

[75] Inventors: Fritz Gränitz, Linz; Gunther Robiczek, Traun; Fridolin Jabkowski; Franz Stoger, both of Linz, all of Austria

[73] Assignee: Vereinigte Osterreichische Eisen- und Stahlwerke-Alphine Montan Aktiengesellschaft, Linz, Austria

[22] Filed: Apr. 26, 1976

[21] Appl. No.: 680,199

[30] Foreign Application Priority Data

Apr. 30, 1975 Austria ..... 3322/75

[52] U.S. Cl. ..... 29/427; 29/401 F; 72/239; 164/282

[51] Int. Cl.[2] ..... B23P 19/04; B22D 11/12

[58] Field of Search ..... 164/282; 72/238, 239; 29/200 D, 426, 427; 214/DIG. 4

[56] References Cited

UNITED STATES PATENTS

| | | | |
|---|---|---|---|
| 3,527,286 | 9/1970 | Meitz | 164/282 |
| 3,735,848 | 5/1973 | Bode et al. | 164/282 |
| 3,763,923 | 10/1973 | Gallucci | 72/239 |
| 3,783,934 | 1/1974 | Golde et al. | 164/282 |
| 3,841,389 | 10/1974 | Anderton et al. | 164/282 |
| 3,889,344 | 6/1975 | Bode et al. | 29/200 D |

*Primary Examiner*—Lowell A. Larson
*Attorney, Agent, or Firm*—Brumbaugh, Graves, Donohue & Raymond

[57] ABSTRACT

A method of and apparatus for exchanging rollers in a continuous casting plant for strands, which plant has opposite roller paths for guiding the strand, involves moving the rollers to be exchanged into or out of their bearing places in the roller paths and transporting them away from or to the bearing place, respectively, in the region between the roller paths in the longitudinal direction thereof. Advantageously, a sled with recesses is provided for delivering and removing the rollers.

11 Claims, 7 Drawing Figures

METHOD OF EXCHANGING SUPPORTING OR DRIVING ROLLERS IN A CONTINUOUS CASTING PLANT AND APPARATUS FOR CARRYING OUT THE METHOD

BACKGROUND OF THE INVENTION

The invention relates to a method for exchanging supporting or driving rollers in a continuous casting plant that has roller paths arranged opposite each other so as to guide the strand, as well as to apparatus for carrying out this method.

The supporting and driving rollers in continuous casting plants, in particular in casting plants for steel strands, are machine parts that are subjected to extremely great wear. Their period of use is relatively short compared with other machine parts used in a continuous casting plant. For this reason the supporting and driving rollers have to be exchanged for new ones or overhauled ones rather frequently when the plant is maintained. If the supporting or driving rollers fail, they have to be substituted within the shortest possible time.

In known continuous casting plants, either a number of supporting and driving rollers are mounted in segments of the stand or they are mounted together in a one-part roller stand. The exchange of a roller is carried out in a plant of this kind by removing the segment of the stand carrying the damaged roller or the one-part roller stand from the continuous casting plant and bringing it to a repair place, where a new roller is installed in the stand part. In the meantime a spare stand part having intact rollers is installed in the continuous casting plant. The exchange of rollers according to this method has significant disadvantages, consisting e.g. in that the exchange of a stand carrying a plurality of rollers requires a good deal of time and is a lot of work, and in that the precise alignment of the segment of the stand or the roller into the strand guide, relative to the adjacent stand parts carrying rollers, which is of eminent importance, takes a lot of time and may lead to faults in the strand guide at the transitions to the neighbouring stand parts. Also, keeping a store of the roller-carrying stand parts is rather complex and involves a high expenditure of funds, especially in bow-type continuous casting plants or in bending/straightening plants, whose arcuate part corresponds to a transition curve.

SUMMARY OF THE INVENTION

The invention aims at preventing these disadvantages and difficulties during a roller exchange and has as its object to create a method of exchanging supporting or driving rollers and an apparatus for carrying out this method, which allow for a quick exchange of individual or a plurality of rollers without necessitating the removal of roller-carrying parts of the plant from their operational position. Furthermore, adjusting operations during the exchange of the rollers are to be prevented and the maintenace of a store of the spare parts is to be facilitated. According to the invention, these objects are achieved in that a roller to be removed is detached from its bearing in the roller path, moved into the space corresponding to the cross-section of the strand between the two roller paths and transported away between the roller paths in their longitudinal direction, and that a roller to be installed is transported longitudinally between the two roller paths to the free bearing place area and is inserted in the free bearing place.

Advantageously, the rollers to be removed and installed are transported between the two roller paths by means of a sled having recesses.

Furthermore, the invention comprises an apparatus for carrying out this method, characterised in that between the roller paths a sled having a recesses for accommodating rollers is movable for transporting a roller from or to a bearing in one of the roller paths, and that a displacement means is provided for moving a roller from its bearing place into a recess of the sled or from a recess into a bearing place.

Advantageously, the sled consists of two or more articulately connected parts. Thereby the number of rollers to be exchanged in a single step can be increased.

According to a preferred embodiment of the invention the sled is articulately connectable to a starter bar a cold strand. Suitably, the sled has releasable holding means for the rollers. These holding means assure that the rollers inserted in the sled do not fall out during transportation between the roller paths and cause, e.g., a jamming of the sled.

It is furthermore suitable for an exchange of the rollers arranged on the lower or outer side of the strand guide, that the distance between the recesses should not equal the distance between rollers in the lower roller paths in order to provide a better sliding effect of the sled on the lower or outer roller path, since a sled of this construction always rests with more than one point on the lower or outer roller path.

For an easy installation and removal of a roller into or out of its bearing place a displacement means is provided with a guide, that is attachable to the sled or to the roller paths, and a catch, that is brought into engagement with the roller end and is guided by the guide.

BRIEF DESCRIPTION OF THE DRAWINGS

The invention shall now be described by way of example and with reference to the accompanying drawings, wherein.

DESCRIPTION OF EXEMPLARY EMBODIMENTS

Figure 1:
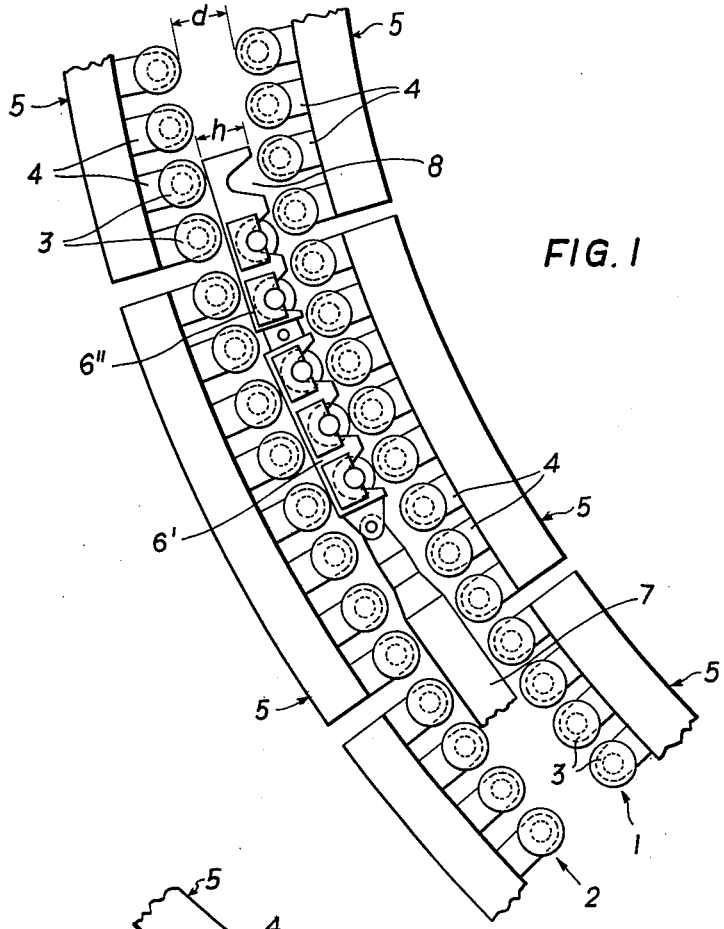
FIG. 1 is a longitudinal section through a part of a schematically illustrated strand guide in which there is a sled for exchanging the supporting rollers arranged on the inner or upper side of the strand guide.
Figure 2:
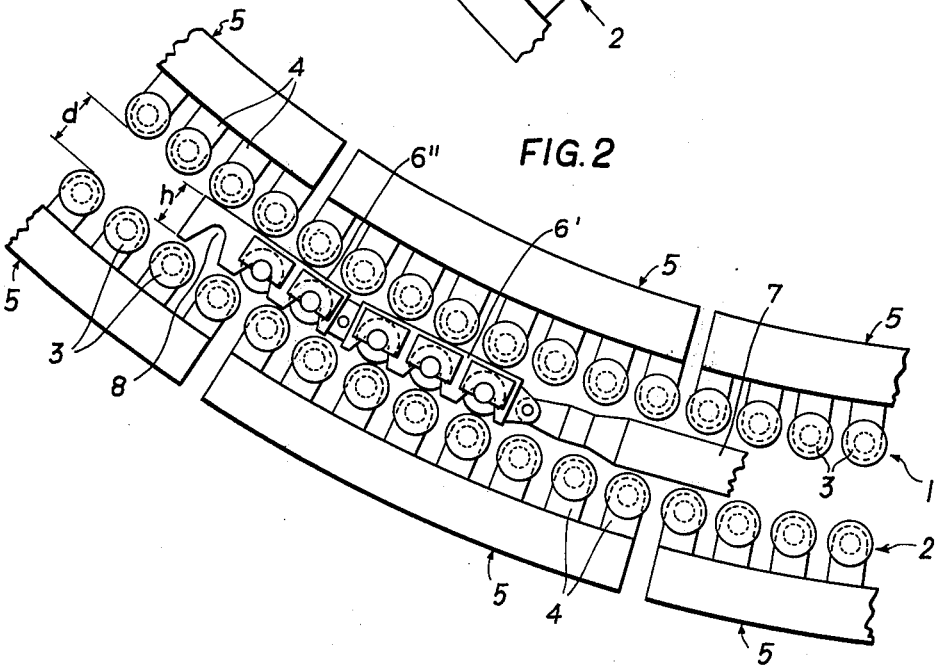
FIG. 2 shows the sled, in a like illustration, introduced between the roller paths fior exchanging the outer or lower supporting rollers.
Figure 3:
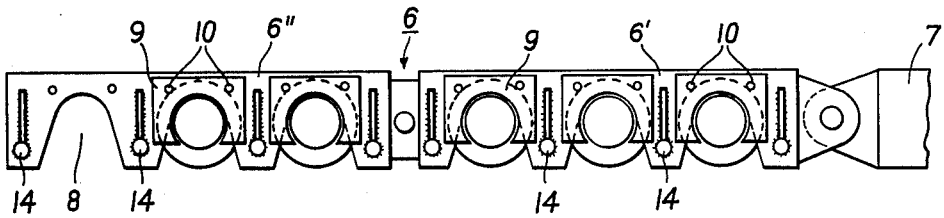
FIG. 3 is a side view of the sled.

An inner and outer roller path 2 of a strand guide have roller path 1 an supporting rollers 3 between which the strand is guided during casting. A number of the supporting rollers 3 are mounted in segments 5 of the stand via bearing supports 4. A sled 6 (FIG. 3) is comprised of two parts 6' and 6'' arranged one behind th other and articulately connected to each other. The height *h* of the sled is somewhat less than the distance *d* between the roller paths. One end of the sled articulately connected to a starter bar 7 and can be displaced together with the latter between the roller paths in the longitudinal direction. The sled 6 is provided with recesses 8 arranged one behind the other and transverse to the longitudinal axis, into which recesses one supporting roller each is insertable. Releasable holding means including locking pieces 9 that, can be pushed onto bolts 10 on both sides of the sled, embrace the rollers inserted into the sled at their ends and secure the rollers against falling out.

Figure 4:
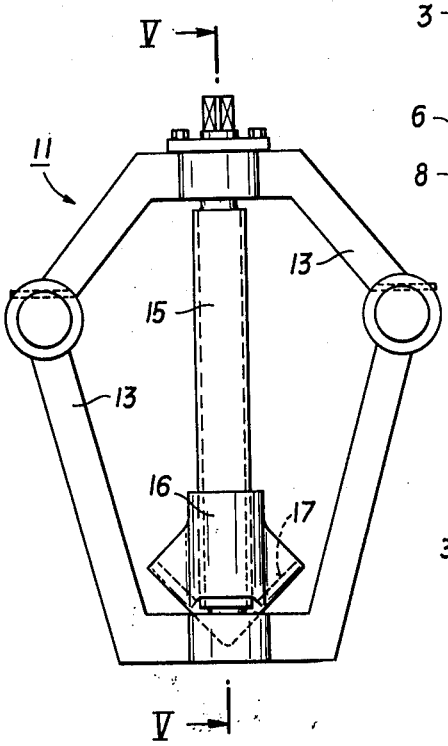
FIGS. 4 and 6 show respective embodiments of each of two roller displacement means.
Figure 5:
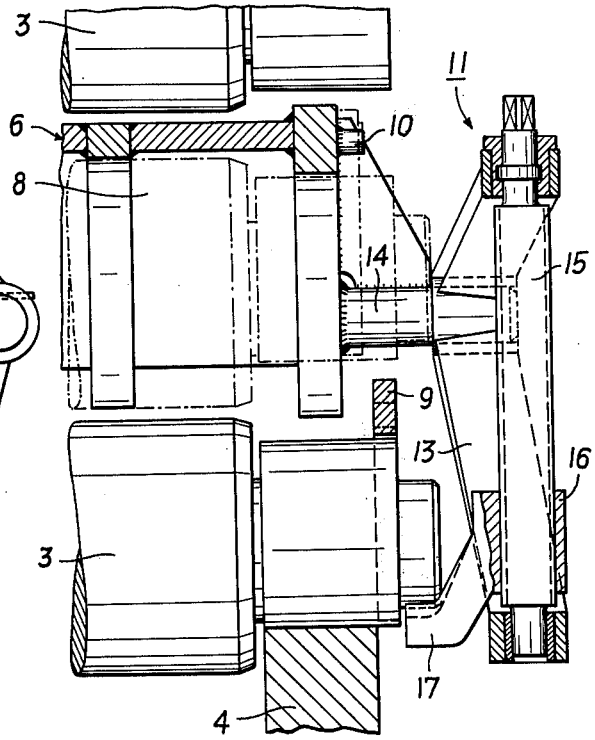
FIG. 5 is a section along line V—V of FIG. 4.

For moving a roller from its bearing place on a bearing support into a recess of the sled or vice versa from a recess of the sled into a bearing place, displacement means 11 (FIG. 4) or 12 (FIG. 6) are provided which are attachable to both sides of the rollers. The displacement means 11, according to FIGS. 4 and 5, has a frame 13 that can be slipped onto the bolts 14 protruding laterally from the sled. In frame 13 a threaded spindle 15 that is rotatable by hand is mounted. A catch 16 is movable with its inner thread along the spindle 15. FIG. 5 illustrates the removal of a roller installed in the lower roller path. The catch 16 with its nose 17 embraces the end of the roller.3 to be removed and brings it into a recess 8 of the sled 6 as soon as the spindle 15 is rotated. Hence, frame 13 and spindle 15 act as a guide for the displacement of the roller. The position of the roller in the sled is illustrated in dot-and-dash-lines.

Figure 6:
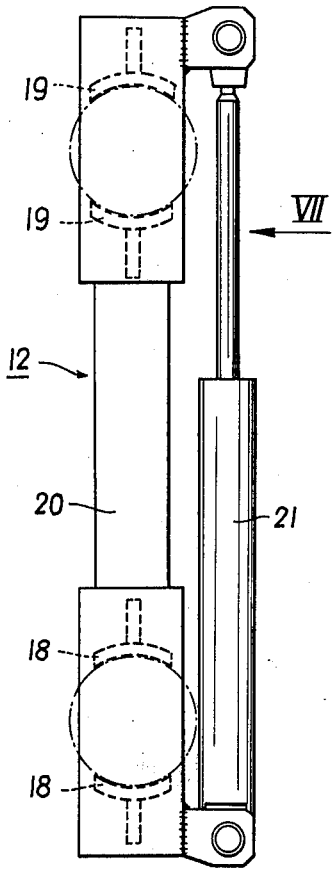
Figure 7:
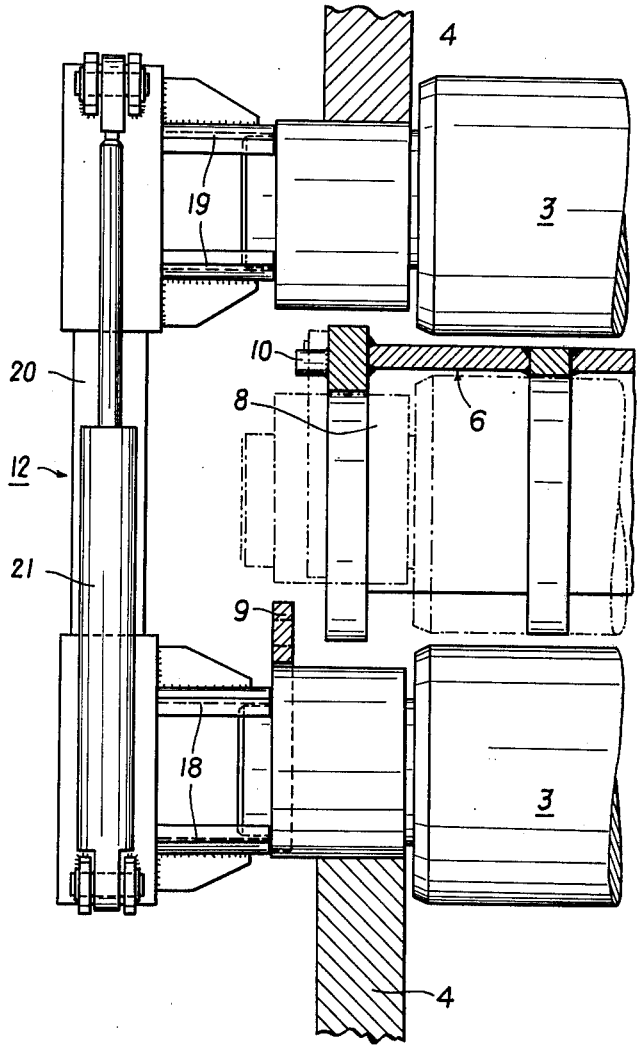
FIG. 7 is a view in the direction of the arrow VII of FIG. 6.

FIGS. 6 and 7 show a second embodiment 12 of the displacement means. This consists of two pairs of jaws 18, and 19 embracing the ends of opposite supporting rollers. The pair of jaws 18 acts as a catch and is displaceable along a guide column 20. The other pair of jaws 19 is rigidly connected to one end of the guide column 20. The movable pair of jaws 18 is displaceable by means of a pressure medium cylinder 21 along the guide column 20. For exchanging a roller, as shown in FIG. 7 for one roller end, one displacement means each, with the displaceable pair of jaws 18 is joined to the two ends of the roller to be removed. The opposing end of each displacement means with the pair of jaws 19 rigidly attached thereto is attached to the ends of the opposite roller. When the bearing fixtures of the roller to be taken out have been released, the pressure medium cylinder 21 is actuated, whereby the roller is displaced into the sled 6 that has been made ready and provided with a free recess 8. The position of the roller lifted into the sled is also illustrated in dot-and-dash-lines in FIG. 7. In principle, it is possible to couple a number of displacement means 11 or 12 and to jointly drive them for the purpose of simultaneously exchanging a number or rollers.

The roller exchange may be carried out in various manners using the sled according to the invention. Thus it is possible to fill all the recesses, except one, with rollers to be installed. The sled is then guided with the empty recess to the first damaged roller of the strand guide by driving the starter bar coupled to the sled. There the roller is inserted into the recess. Then the sled is moved on, until the first roller to be installed is above the bearing place that is empty then, and this roller is inserted into the bearing place. Thereby another recess has become free for inserting the next damaged roller to be exchanged, whereupon the next exchange can be carried out. Advantageously, this method is applied when only a few non-neighbouring rollers of a roller path are to be exchanged.

For exchanging all the rollers of a strand guide, as is necessary e.g. when the continuous casting plant needs overhauling, it is advantageous to fill only half the number of recesses with new rollers, to move the sled between the roller paths, to simultaneously fill the emtpy recesses of the sled with the rollers to be exchanged, to then displace the sled until all the new rollers are opposite empty bearing places, and finally to simultaneously displace the new rollers into the roller path and to install them.

When all of the rollers are exchanged the distance of the recesses between the sled has to be exactly the same as the distance between the rollers in each of the roller paths. For exchanging the rollers arranged at the lower or outer side of the strand guide, it will therefore be suitable to fill every second recess of the sled with a new roller, so that the sled slides with the new rollers on the lower or outer roller path over its entire length and does not sag between the rollers of that roller path.

This second method has the advantage that the sled needs to be displaced only once for the exchange of a number or rollers.

What we claim is:

1. In a method of exchanging rollers in a plant for continuously casting strands, in which plant a plurality of rollers is arranged in bearing places and define opposite roller paths located at a distance from each other corresponding to the cross-section of the strand to be cast, the improvement comprising the steps of releasing a roller to be removed from its bearing place, moving said roller to be removed into the space between the opposite roller paths, transporting the roller to be removed longitudinally between the roller paths away from its bearing place, transporting a roller to be installed longitudinally between the opposite roller paths toward a free bearing place, and inserting the roller to be installed in the free bearing place.

2. A method as set forth in claim 1, wherein said rollers are supporting rollers.

3. A method as set forth in claim 1, wherein said rollers are driving rollers.

4. A method as set forth in claim 1, wherein the rollers to be removed and installed are transported between said roller paths by means of a sled having recesses.

5. An arrangement for exchanging rollers in a plant for continuously casting strands, in which plant a plurality of rollers is arranged in bearing places and define opposite roller paths located at a distance from each other corresponding to the cross-section of the strand to be cast, which comprises a sled movable between the roller paths and having recesses for accommodating rollers therein so as to transport the rollers from and to their respective bearing places in the roller paths, and displacement means for moving a roller to be removed from its bearing place into one of the recesses in the sled and moving a roller to be installed from one of the recesses in the sled into the respective bearing place.

6. An arrangement as set forth in claim 5, wherein the sled comprises at least two articulately connected parts.

7. An arrangement as set forth in claim 5, wherein the sled is articulately connectable to a starter bar.

8. An arrangement as set forth in claim 5, wherein the sled comprises releasable holding means for the rollers.

9. An arrangement as set forth in claim 5, wherein the recesses in the sled are spaced differently from the rollers in the roller paths.

10. An arrangement as set forth in claim 5, further comprising a guide on the displacement means, which guide is attachable to the sled, and a catch which is engageable with a roller end and which is guided on said guide.

11. An arrangement as set forth in claim 5, further comprising a guide on the displacement means, which guide is attachable to the roller paths, and a catch which is engageable with a roller end and which is guided on said guide.

* * * * *

UNITED STATES PATENT AND TRADEMARK OFFICE

CERTIFICATE OF CORRECTION

PATENT NO. : 4,012,825

DATED : Mar. 22, 1977

INVENTOR(S) : Fritz Gränitz et al

It is certified that error appears in the above-identified patent and that said Letters Patent are hereby corrected as shown below:

First page, Item [73], "Alphine" should read --Alpine--.

Col. 1, line 60, "maintenace" should read --maintenance--.

Col. 2, line 19, after "bar" insert --or--; line 49, "fior" should read --for--; lines 59 & 60, "An inner and outer roller path 2 of a strand guide have roller path 1 an" should read --An inner roller path 1 and an outer roller path 2 of a strand guide have--; line 65, "th" should read --the--; line 67, after "sled" insert --is--.

Col. 3, line 6, "9 that," should read --9, that--; line 29, "18," should read --18--; line 37, after "18" insert a comma; line 50, "or" should read --of--.

Col. 4, line 2, "emtpy" should read --empty--;

line 20, "or" should read --of--.

Signed and Sealed this fifth Day of July 1977

[SEAL]

Attest:

RUTH C. MASON
Attesting Officer

C. MARSHALL DANN
Commissioner of Patents and Trademarks